US005560602A

United States Patent [19]

Johnson et al.

[11] Patent Number: 5,560,602

[45] Date of Patent: Oct. 1, 1996

[54] PINBALL MACHINE CABINET ASSEMBLY

[75] Inventors: Charles F. Johnson, Elgin; Manolo R. DeLa Torriente, Algonquin, both of Ill.

[73] Assignee: Capcom Coin-Op, Inc., Arlington Heights, Ill.

[21] Appl. No.: 393,343

[22] Filed: Feb. 23, 1995

[51] Int. Cl.[6] ..... A63F 7/36

[52] U.S. Cl. ..... 273/118 R; 273/118 A; 312/223.1; 181/199

[58] Field of Search ..... 273/118, 119, 273/121; 312/8.16, 223.6, 223.1, 7.1; 181/150, 151, 171, 199; 381/88

[56] References Cited

U.S. PATENT DOCUMENTS

| | | | |
|---|---|---|---|
| 2,866,514 | 12/1958 | Weathers | 181/151 |
| 4,647,043 | 3/1987 | Wiczer | 273/121 R |
| 4,648,599 | 3/1987 | Wiczer . | |
| 4,805,906 | 2/1989 | Wiczer et al. . | |
| 4,939,783 | 7/1990 | Dunning | 181/150 X |
| 5,330,182 | 7/1994 | Kaminkow | 273/118 R X |

FOREIGN PATENT DOCUMENTS

| | | | |
|---|---|---|---|
| 2522945 | 9/1983 | France | 312/8.16 |

*Primary Examiner*—Raleigh W. Chiu
*Attorney, Agent, or Firm*—Robert E. Browne; Gary R. Jarosik

[57] ABSTRACT

A pinball machine cabinet is provided comprising a playfield box and a back box attached thereto. The back box contains electronic driving circuitry and includes a speaker panel attached thereto, the speaker panel being movable between an open position and a closed position for allowing access to the electronic driving circuitry. A hinge is provided to connect the speaker panel to the back box and a clasp is associated with speaker panel for maintaining the speaker panel in the closed position. A pair of stereo speakers and a display unit are mounted to the speaker panel. A pair of speaker cabinets may be disposed within the back box into which are disposed the pair of stereo speakers when the speaker panel is disposed in the closed position. Each of the speaker cabinets may also be provided with a sound proofing liner of which a portion thereof is positioned to extend beyond the edge of the cabinet for engaging the back of the speaker panel for the purpose of sound proofing any gaps which may exist between the back of the speaker panel and the front edge of each speaker cabinet when the speaker panel is in the closed position.

12 Claims, 2 Drawing Sheets

PINBALL MACHINE CABINET ASSEMBLY

BACKGROUND OF THE INVENTION

This invention relates generally to amusement games and, more particularly, relates to a back box assembly for use in conjunction with a coin operated pinball machine.

As known, pinball machines are typically designed having a glass covered playfield box in which the playfield assembly is disposed and a glass covered back box connected thereto which includes any scoring or display panels and speakers for the audio system. In order to maintain the components and circuitry within the back box the back glass is first removed and the panel to which the speakers are mounted is subsequently removed whereby access may be gained. During this process, when the speaker panel is separated from the back box, the servicer usually places the speaker panel upon the playfield box as the servicer proceeds to examine or repair the back box components. At this time, owing to the incline of the playfield box, the speaker panel typically slides away from the back box down the glass whereby the speaker wires connecting the speakers to their associated components risk breaking. One option to prevent breakage is to disconnect the speaker wires from the speakers. However this solution places the entire unit at risk of sliding onto the floor where the speakers themselves will suffer damage from the fall. As such, a need exists whereby entry into the back box may be gained easily while the speaker assembly and related components may be safeguarded from damage.

As a result of these existing needs, it is an object of the present invention to provide a speaker panel attached to the back box in such a manner that the speaker panel may be moved to gain access to the components located therebehind without having to be detached.

It is a further object of the present invention to improve the sound of the speakers mounted on the speaker panel by further modifying the back box and speaker panel to provide sound enhancing qualities.

SUMMARY OF THE INVENTION

In accordance with the present invention, an electronic game cabinet is provided comprising a playfield box and a back box attached thereto. The back box contains electronic driving circuitry and includes a speaker panel attached thereto, the speaker panel being movable between an open position and a closed position for allowing access to the electronic driving circuitry. A hinge is provided to connect the speaker panel to the back box and a clasp is associated with speaker panel for maintaining the speaker panel in the closed position. A pair of stereo speakers and a display unit are mounted to the speaker panel. A pair of speaker cabinets may be disposed within the back box into which are disposed the pair of stereo speakers when the speaker panel is disposed in the closed position. Each of the speaker cabinets may also be provided with a sound proofing liner of which a portion thereof is positioned to extend beyond the edge of the cabinet for engaging the back of the speaker panel for the purpose of sound proofing any gaps which may exist between the back of the speaker panel and the front edge of each speaker cabinet when the speaker panel is in the closed position.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

Figure 1:
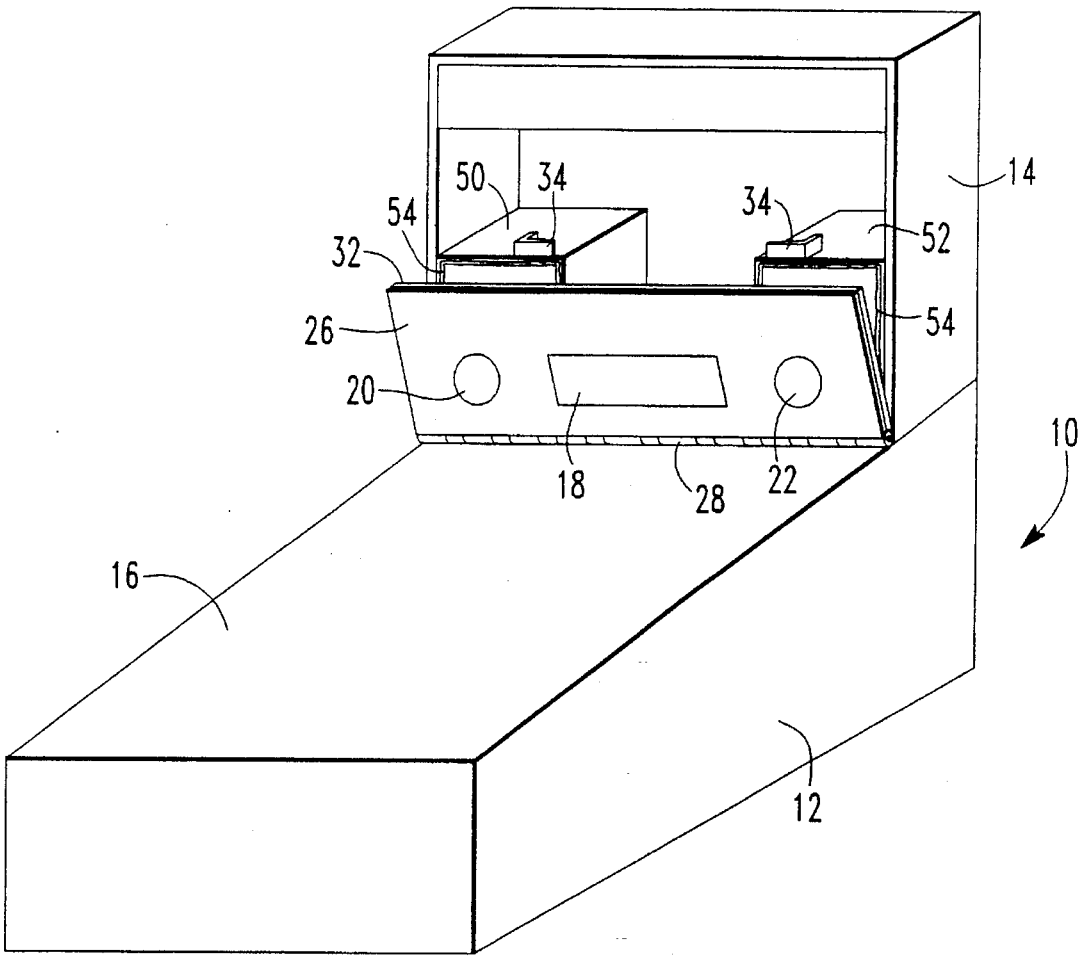
FIG. 1 illustrates the speaker panel assembly and pinball machine which is the subject of the present invention with the speaker panel partially open.
Figure 2:
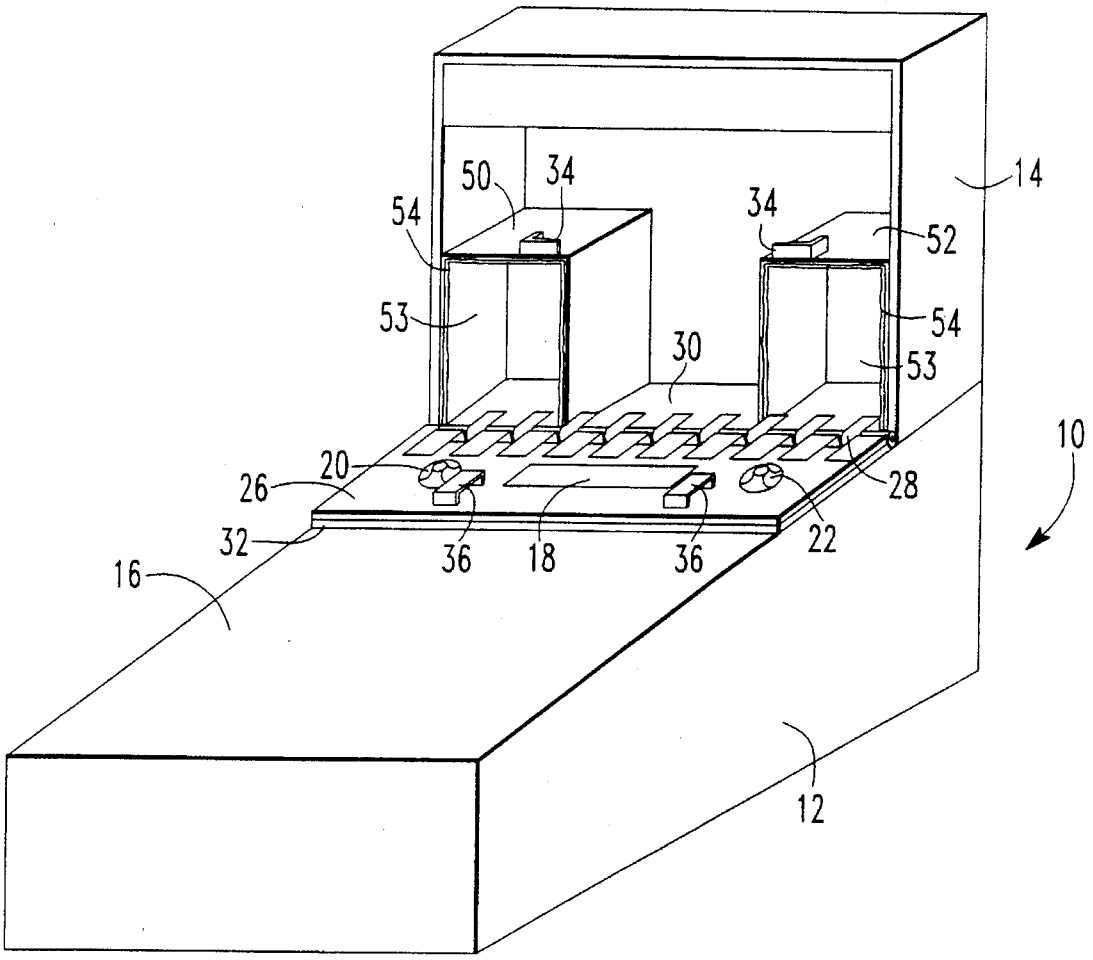
FIG. 2 illustrates the speaker panel assembly and pinball machine which is the subject of the present invention with the speaker panel fully open.

While the invention can be used in conjunction with electronic amusement devices it will be described hereinafter in the context of a back box speaker panel assembly for use in a coin operated pinball machine as the preferred embodiment thereof.

Referring now to the figures, wherein like reference numerals refer to like elements, there is shown generally a pinball machine 10. Pinball machine 10 comprises playfield box 12 in which the playfield (not shown) is disposed and back box 14. The playfield is secured within playfield box 12 by playfield glass 16. The back box 14, which is secured to the playfield box 12 in a known manner, houses display 18, right and left stereo speakers 20,22 and associated hardware. The back box further includes a feature glass (not shown) which typically contains artwork associated with the pinball game and behind which is typically mounted lighting.

The back box 14 further includes a speaker panel 26 on which is mounted the left/right speakers 20, 22 and display 18 which are wired to the associated componentry (not shown) mounted in the back box 14. The speaker panel 26 is mounted to the back box 14 by hinges 28, preferably in a manner such that the speaker panel 26 will rest upon the playfield glass 16 when in the fully open position. In the preferred embodiment, piano hinges are used and positioned with one hinge flange being mounted to the inside bottom 30 of the back box 14 with the other hinge flange being mounted to the inside bottom of the speaker panel 26.

The speaker panel 26 is further equipped with a generally U-shaped channel 32 mounted to the top thereof in which the feature glass is disposed when the back box is secured in the closed position. As known in the art, the feature glass is locked into the back box at the top thereof where a key is necessary to free the feature glass for removal. Once unlocked, the feature glass is raised from the channel 32 and removed exposing the top interior of the back box. To maintain the speaker panel assembly 26 in the secured, upright position a conventional sliding latch mechanism is provided including sliding clasp 34 which is matable with an extending flange 36 mounted to the backside of the speaker panel. In order to open the speaker panel 26 the sliding clasp 34 is pushed away from the flange 36 whereby the flange 36 will be freed thus allowing the speaker panel to be moved. To secure the panel 26 in the upright position, the sliding clasp 34 is pushed over the flange 36 thus preventing the speaker panel from moving.

The back box 14 may also be equipped with optional left/right speaker cabinets 50,52 for the purpose of enhancing the sound produced from left/right stereo speakers 20,22. The speaker cabinets as shown are constructed to have an opening 53 in which the speakers 20,22 are disposed when the speaker panel 26 is placed in the closed position. Preferably, the speaker cabinets 50,52 are provided with a conventional lining 54 such as foam rubber or the like in order to minimize sound bleed from the cabinets. The lining 54 is also preferably arranged such that it extends beyond the edges of the speaker cabinets 50,52 for further sound proofing. Specifically, the lining 54 is extended far enough to make flush contact with back side of speaker panel 26 when the speaker panel 26 is in the closed position whereby any gaps which may exist between the speaker cabinets 50,52 and the speaker panel 26 will be sealed to prevent sound leakage. Alternatively, the back side of the speaker panel 26 may be provided with a liner for sealing any gaps which may exist between the edge of the speaker cabinets 50,52 and the back of the speaker panel 26 when the speaker panel 26 is closed. Furthermore, the display 18 may be covered within the interior of the back box 14 to prevent damage when the speaker panel 26 is positioned in the lowered position.

It should be apparent from the preceding description that this invention has among other advantages, the advantage of improved access to the components secured in the pinball back box and the advantage of enhanced stereo sound.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

We claim:

1. A pinball machine, comprising:

a playfield box;

a back box attached to said playfield box containing electronic driving circuitry and having a panel associated therewith; and a hinge connecting said panel to said back box whereby said panel may be opened to allow access to said electronic driving circuitry contained within said back box.

2. The pinball machine of claim 1, further comprising a speaker mounted on said panel.

3. The pinball machine of claim 2, wherein said hinge is a piano hinge attached to the inside, bottom of said back box and the back, bottom of said panel.

4. The pinball machine of claim 3, further comprising a clasp for securing said panel in closed relation with said back box.

5. The pinball machine of claim 3, further comprising a display mounted on said panel.

6. The pinball machine of claim 1, further comprising a pair of stereo speakers mounted on said panel.

7. A pinball machine, comprising:

a playfield box;

a back box attached to said playfield box containing electronic driving circuitry and having a speaker panel hingedly associated therewith on which is mounted at least one speaker, said speaker panel being provided to allow access to said electronic driving circuitry; and at least one speaker cabinet disposed within said back box having an opening into which is disposed said at least one speaker when said speaker panel is disposed in closed relation with said back box.

8. The pinball machine as recited in claim 7, comprising a pair of stereo speakers and a corresponding pair of speaker cabinets.

9. The pinball machine as recited in claim 8, wherein said pair of speaker cabinets comprises a liner for sound proofing said pair of speaker cabinets.

10. The pinball machine cabinet as recited in claim 9, wherein said liner comprises a foam rubber.

11. The pinball machine as recited in claim 9, wherein said liner extends beyond the edge of said opening for engaging the back of said speaker panel when said speaker panel is in closed relation with said speaker cabinet for sound proofing any gaps which exist therebetween.

12. A pinball machine, comprising:

a playfield box;

a back box attached to said playfield box containing electronic driving circuitry and having a speaker panel attached thereto, said speaker panel being movable between an open position and a closed position for allowing access to said electronic driving circuitry;

a hinge connecting said speaker panel to said back box;

a clasp associated with said speaker panel for maintaining said speaker panel in said closed position;

a pair of stereo speakers mounted to said speaker panel; and a pair of speaker cabinets disposed within said back box having an opening into which are disposed said pair of stereo speakers when said speaker panel is disposed in said closed position;

wherein said pair of speaker cabinets each comprise a sound proofing liner, said liner having a portion which extends beyond said opening for engaging the back of said speaker panel for sound proofing any gaps which exist between said speaker panel and said pair of speaker cabinets when said speaker panel is in said closed position.

* * * * *